US007418935B2

(12) United States Patent
Flierl et al.

(10) Patent No.: US 7,418,935 B2
(45) Date of Patent: Sep. 2, 2008

(54) STROKE ADJUSTING DEVICE FOR VALVES OF A COMBUSTION ENGINE

(75) Inventors: Rudolf Flierl, Kaiserslautern (DE); Mark Andy Mohr, Kaiserslautern (DE); Daniel Gollasch, Kaiserslautern (DE)

(73) Assignee: Hydraulik-Ring GmbH (DE)

( * ) Notice: Subject to any disclaimer, the term of this patent is extended or adjusted under 35 U.S.C. 154(b) by 163 days.

(21) Appl. No.: 10/518,739

(22) PCT Filed: Jun. 20, 2003

(86) PCT No.: PCT/EP03/06550

§ 371 (c)(1),
(2), (4) Date: Mar. 21, 2006

(87) PCT Pub. No.: WO04/001198

PCT Pub. Date: Dec. 31, 2003

(65) Prior Publication Data

US 2006/0201459 A1 Sep. 14, 2006

(30) Foreign Application Priority Data

Jun. 20, 2002 (DE) ..... 102 28 022

(51) Int. Cl.
*F01L 1/18* (2006.01)

(52) U.S. Cl. ..... 123/90.39; 123/90.16; 123/90.44; 74/569

(58) Field of Classification Search ..... 123/90.16, 123/90.2, 90.39, 90.44; 74/559, 567, 569
See application file for complete search history.

(56) References Cited

U.S. PATENT DOCUMENTS

| | | | | |
|---|---|---|---|---|
| 4,397,270 | A | 8/1983 | Aoyama | |
| 6,481,399 | B1 | 11/2002 | Morrn | |
| 6,792,903 | B2 * | 9/2004 | Morrn | 123/90.16 |
| 7,044,094 | B2 * | 5/2006 | Bosl-Flierl et al. | 123/90.44 |
| 2002/0162522 | A1 | 11/2002 | Morrn | |

FOREIGN PATENT DOCUMENTS

| | | |
|---|---|---|
| DE | 19509604 | 9/1996 |
| DE | 10100173 | 7/2002 |
| DE | 10164493 | 7/2003 |
| DE | 10235401 | 2/2004 |
| EP | 1255027 | 5/2001 |

OTHER PUBLICATIONS

Unger, H, "Konstruktionen and Untersuchungen zum mechanischen vollvariablen Ventiltrieb" (Dissertation), Technische Universitaet Muenchen (Germany), 1997.

* cited by examiner

*Primary Examiner*—Ching Chang
(74) *Attorney, Agent, or Firm*—Jones Day

(57) ABSTRACT

A device for adjusting the valve lift (1) of the valves of a combustion engine comprising a lever (3) being driven by a camshaft (4), pushed against the camshaft (4) by a spring, which cooperates with at least one valve engagement means and is positioned by a positioning means (6).

3 Claims, 6 Drawing Sheets

STROKE ADJUSTING DEVICE FOR VALVES OF A COMBUSTION ENGINE

Figure 1:
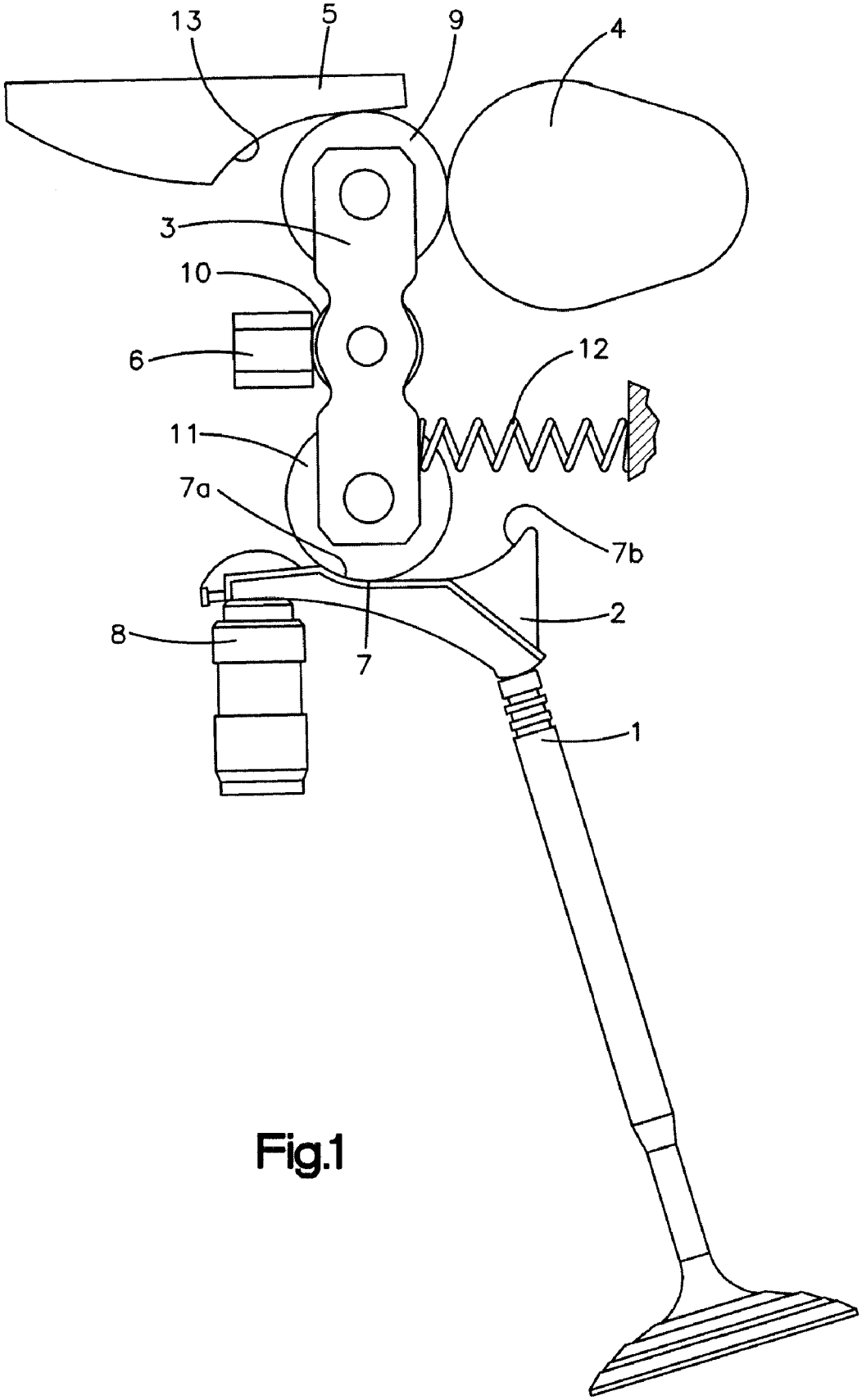

The invention relates to a device for adjusting the valve lift of valves in combustion engines and to a method for adjusting the valve lift of valves in combustion engines. Furthermore, the invention relates to combustion engines comprising a device for valve lift adjustment.

Devices for adjusting the valve lift in combustion engines typically comprise a cam shaft driving a valve engagement means, this usually being a roller lever, which cooperates with the valve and moves the latter. More complex devices comprise additional levers being arranged between the valve engagement means and the camshaft. Those levers are typically turning levers, i.e. one-armed levers. An example for such a device is given in EP-A1-01 255 027 which describes a mechanically controllable valve lift adjustment for gas exchange valves of combustion engines wherein a turning lever is driven by a cam shaft and cooperates with a valve engagement means (that means being a roller lever). The turning lever is positioned by a positioning means and pushed back towards the camshaft by a spring. The turning lever also comprises an external roller which rolls over a bearing that is part of the engine.

It is an object of the present invention to provide a device for adjusting the valve lift of valves of combustion engines which has a lower moment of inertia compared to known devices for valve lift adjustment thus helping to improve the efficiency of combustion engines. It is also an object of the invention to provide a device for adjusting the valve lift that allows the realization of high revolutions and/or valve accelerations. Another object of the invention is to provide a device that enables a more fine-tuned and easily achieved adjustment of low valve lifts during the periods of idle strokes in combustion engines. A further object of the invention is to provide a device for the adjustment of the valve lift in combustion engines showing fewer signs of wear compared to other known devices.

Provided by the invention is a device for stroke adjustments of valves (1) of a combustion engine, the device comprising a lever (3) driven by a cam shaft (4), said lever having at least two arms, wherein at least one arm moves on a bearing (5), said lever (3) is pushed against the cam shaft (4) by a biasing means (12) and positioned by at least one positioning means (6) and cooperates with a valve engagement means (2) that cooperates with at least one valve of the combustion engine.

Also provided by the invention is a combustion engine comprising a device as above.

Further provided by the invenition is a lever suitable for the valve lift adjustment device for combustion engines as above having at least two arms one of which comprises a means for bearing the lever rotatably in a bearing that is attached to or part of the engine, the lever further comprises a means for cooperating with a camshaft driving the lever said lever further comprises a means for cooperating with a positioning means displacing the lever, the lever further comprising a means for cooperating with at least one valve engagement means that moves at least one valve of the engine.

Additionally provided by the invention is a method for adjusting the valve lift of valves (1) characterized in that for the adjustment of the valve lift, rocker levers (3, 3*a*, 3*b*) are operated, which are positioned by positioning means (6), and which are driven in a path (13) by a cam shaft (4).

The device and method according to the invention provide a controllable and variable, preferably mechanical, adjustment of the valve lift in a combustion engine. The present invention allows the lift of several valves be adjusted independently and variably. The valve lift can be increased or reduced depending on the engine performance (such as for example the revolution and/or the acceleration) required. Suitable combustion engines are engines for motor vehicles, ship or aircraft engines. The engines can be single- or multiple valve engines. The engines can also be single as well as multiple cylinder engines. Typically the valves to be adjusted are gas-exchanges valves, inlet or intake and/or outlet/exhaust valves.

The device according to the invention is particularly suitable for revolutions of from more than 0 to up to 4000, preferably up to 6000 and more preferably up to 8.000 rpm (revolutions per minute).

In the device according to the invention the lever is driven by a camshaft and cooperates with a valve engagement means, driving the same. The valve engagement means cooperates with the valve and moves the latter. By displacing the lever, i.e. varying the position of the pivot of the lever with respect to the valve engagement means the valve lift is adjusted. Displacement of the lever, i.e the positioning of the lever, is achieved by a positioning means.

The device according to the invention comprises a lever having at least two arms. Each of the arms has at least one outer end. The part of the lever between the outer ends of the arms is referred to herein as the body area of the lever.

Preferably, the lever is a rocker lever. A rocker lever is understood herein to mean a lever which turns around a pivot wherein the pivot is not located at or in proximity to the outer ends of the lever. Preferably the pivot of the rocker lever is situated in or substantially in proximity to the center of mass the lever.

The lever has at least two arms, one of them comprising, preferably at the outer end, a means for bearing the lever, preferably rotatably, in a bearing. That means is preferably a roller but can for example also be a suitable shape or rigid contour of the lever allowing a rather frictionless movement of the lever on the bearing. The bearing is preferably attached to the engine or is a part of the engine.

The shape of the bearing determines the path on which the lever moves. The shape of the bearing can be plane, curved or it can be of circular or semi-circular shape.

The lever is driven by action of a camshaft or a means transmitting the driving force of a camshaft, preferably by cooperating with the means bearing the lever in the bearing. The lever may also comprise a means for cooperating with the camshaft. Such a means can for example be a suitable shape or rigid contour of the lever allowing a rather frictionless cooperation. The means can also be a roller. Preferably, the means cooperating with the camshaft are identical to the means bearing the lever in the bearing.

The lever is pushed against the camshaft by a biasing means, which is preferably a spring.

The lever acts on a valve engagement means, preferably by its other arm and preferably by the cooperation of one or more further roller with one or more working curve or further bearing. For this purpose the lever may comprise one or more further roller which cooperates with a working curve or a bearing located on the valve engagement means. The lever may also comprise a working curve or a further bearing with cooperates with a roller on the valve engagement means, which in this case is preferably a roller lever.

In one embodiment of the invention the working curve is divided into curve areas, for example a zero valve lift area and a valve lift area, wherein the areas can be linked by transition curves or radii.

The valve engagement means cooperates with at least one valve and moves the latter. Typical valve engagement means are roller levers or drag (turning) levers. It is an advantage of the invention that the device is not limited to one specific typ of valve engagement means, The valve engagement means can for example also be a pivoted rocker lever or a non-rotatable lever moved in a guide.

A positioning means cooperates with the lever and positions the lever and the lever further comprises a means for cooperating with a positioning means displacing the lever.

If the two-or more armed lever comprises at least two rollers, those rollers are preferably aligned along an axis of the lever.

The lever can be made from materials providing a sufficient stiffness. Preferably light materials are used which contribute to reducing the inertia of the lever. Suitable materials are, for example, aluminum, titanium or alloys thereof, steal, steal mixtures, suitable plastics or composite materials. The bearings can be made of the same or different material to the engine and/or the lever.

The lever is positioned by a positioning means for the adjustment of the valve lift. The positioning means act on the pivot of the lever and the lever moves around the positioning means. The positioning means is suitably formed and/or has a suitable contour to facilitate the movement of the lever around the positioning means. The lever comprises a means for cooperating with the positioning means.

Such means may be a suitable shape or rigid contour or a roller, in order to facilitate the movement of the lever along the contour of the positioning means. Such a roller, shape or contour however should not be identical to the one on which the camshaft acts for moving the lever. The positioning means is for example a suitably shaped driven rail that can be brought in various positions, for example, by moving it forward or backward. Depending on the position the positioning means is brought into, the pivot of the lever is displaced with respect to the valve engagement means. The positioning means can be driven and positioned in any suitable manner known to the person skilled in the art, for example, mechanically, hydraulically, pneumatically, electrically, electromagnetically and/or piezo-electrically. The lever is displaced by action of the positioning means in accordance with the requirements as to the performance of the engine. Such requirements can be combustion valves, revolutions and/or turning moments. Preferably, the positioning means in accordance to a required torque.

In one embodiment of the device to the cylinder of the engine comprises more than one valve, for example more than one intake valve per cylinder and each valve cooperates via a valve engagement means with the lever. The levers according to this embodiment may be arranged on a common axis and are positioned preferably by one positioning means per lever such that for each valve the valve lift can be controlled and adjusted individually. For example, for the individual valve lift adjustment of two gas exchange valves, for example two intake or exhaust valves respectively, or one intake and one exhaust valve an arrangement is provided wherein two rollers on two rocker levers are located on a common axis and wherein each of these rollers rolls in a separate bearing and the levers being displaced independently from each other depending on the position of the positioning means.

The device according to the invention and the configuration of the lever allows in particular to achieve high revolutions. The working curve and the contour of the positioning means can be shaped such as to increase the maximum stroke acceleration of the intake or exhaust valve on reducing the valve lift. The device furthermore allows the opening time of the valves being reduced on reducing the valve lift.

One embodiment of the invention is a device for the controllable variable adjustment of the valve lift of gas exchange valves in a combustion engine wherein additional rocker levers are moved in a divided bearing, driven by a cam shaft and positioned by a positioning means. A roller of the rocker lever rolls over a bearing that is attached to or is part of the engine and a second roller rolls over a bearing which is part of a valve engagement means. For adjusting the valve lift the positioning means are driven in a guide according to a required turning moment. The arrangement and the configuration of the rocker lever allows for achieving also high revolutions. By using a rocker lever having two rollers, the moment of inertia can be reduced compared to a turning lever comprising only one roll. Furthermore, the rocker lever can be made of aluminum contributing to a further reduction of the dynamic forces. The embodiment can also be used to adjust low valve lifts during idle stroke periods of a multiple cylinder combustion engine for minute variations for each cylinder since one part of the bearing is a part or an integral part of the valve engagement means.

A further embodiment of the invention is a device for the mechanical adjustment of the valve lift wherein a rocker lever is driven by a cam shaft and biased by a spring and moves with a first roller over a bearing and with a second roller over the contour of an adjustable rail (positioning means) that cooperates with a valve engagement means being a roller lever. The bearing over which the lever moves and the contour of the positioning means may comprise plane surfaces which are, in a preferred embodiment, aligned perpendicularly to each other. A feature of this embodiment is that the opening period of the valve can be reduced by reduction of the valve lift. Preferably, the bearing is curved and the curvature of the bearing is determined by the circular arc around the center point of the roller of the roller lever with which the rocker lever cooperates. The rocker lever comprises a working curve which cooperates with the roller of the roller lever (the valve engagement means). The working curve has a first area and that first area has the curvature of a circular arc around the center point of the first roller.

The working curve and the contour of the positioning means are preferably arranged such that the acceleration of the intake or exhaust valves, respectively, increases with reducing valve lift.

Figure 2:
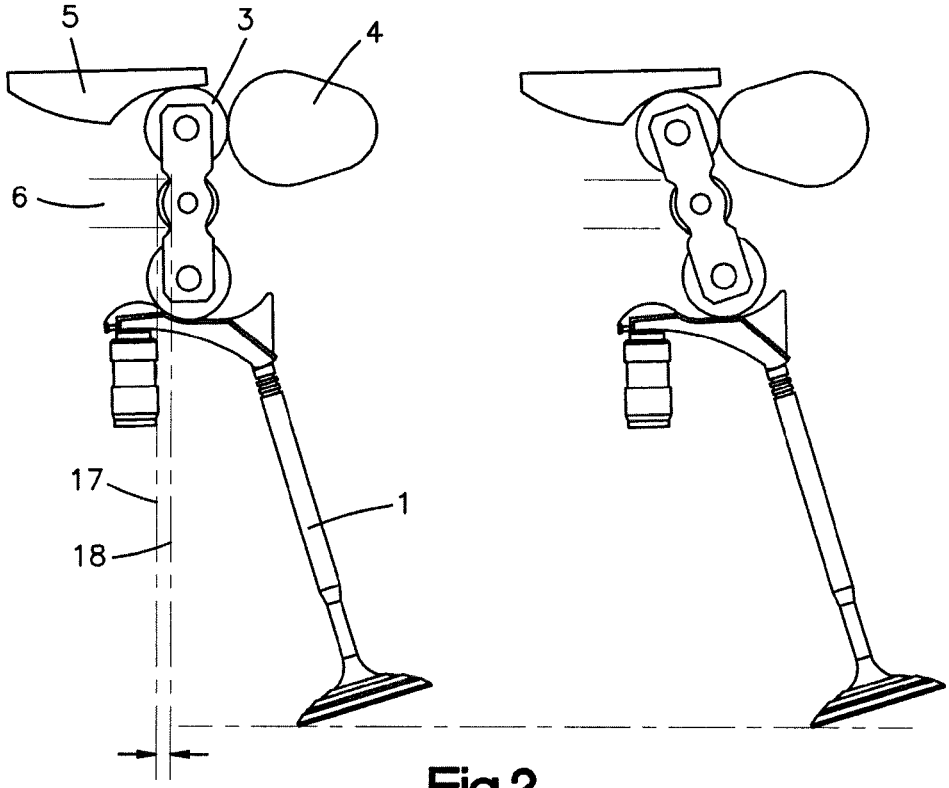
Figure 3:
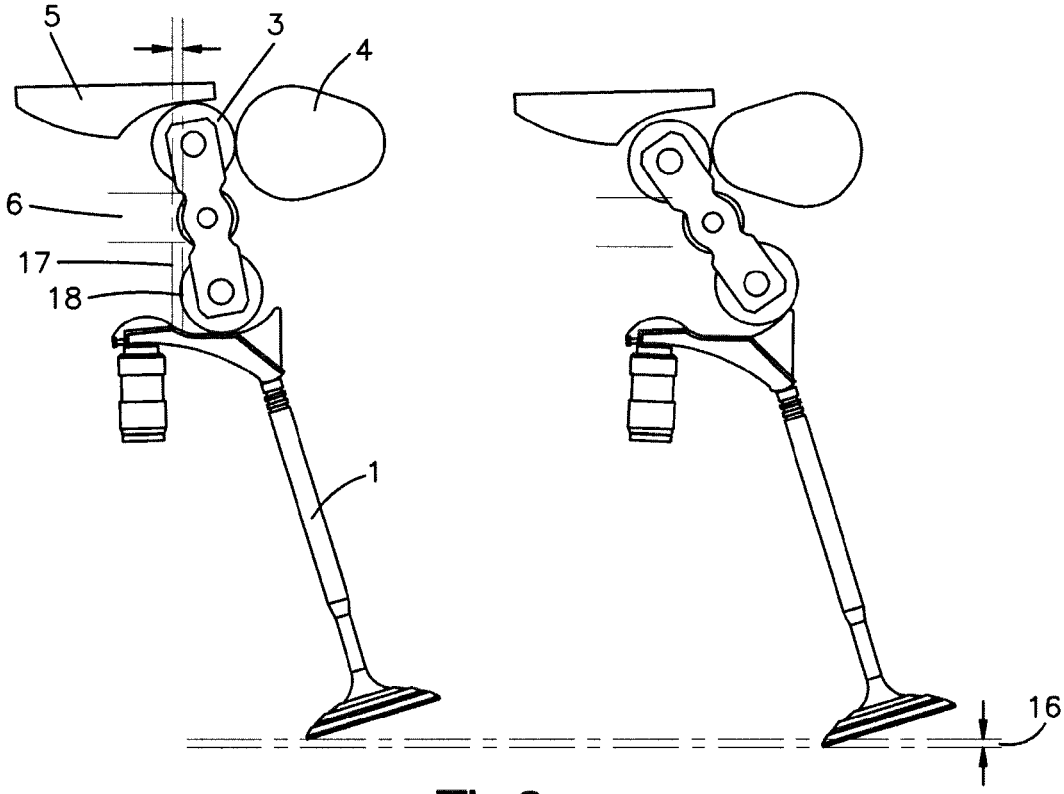
Figure 4:
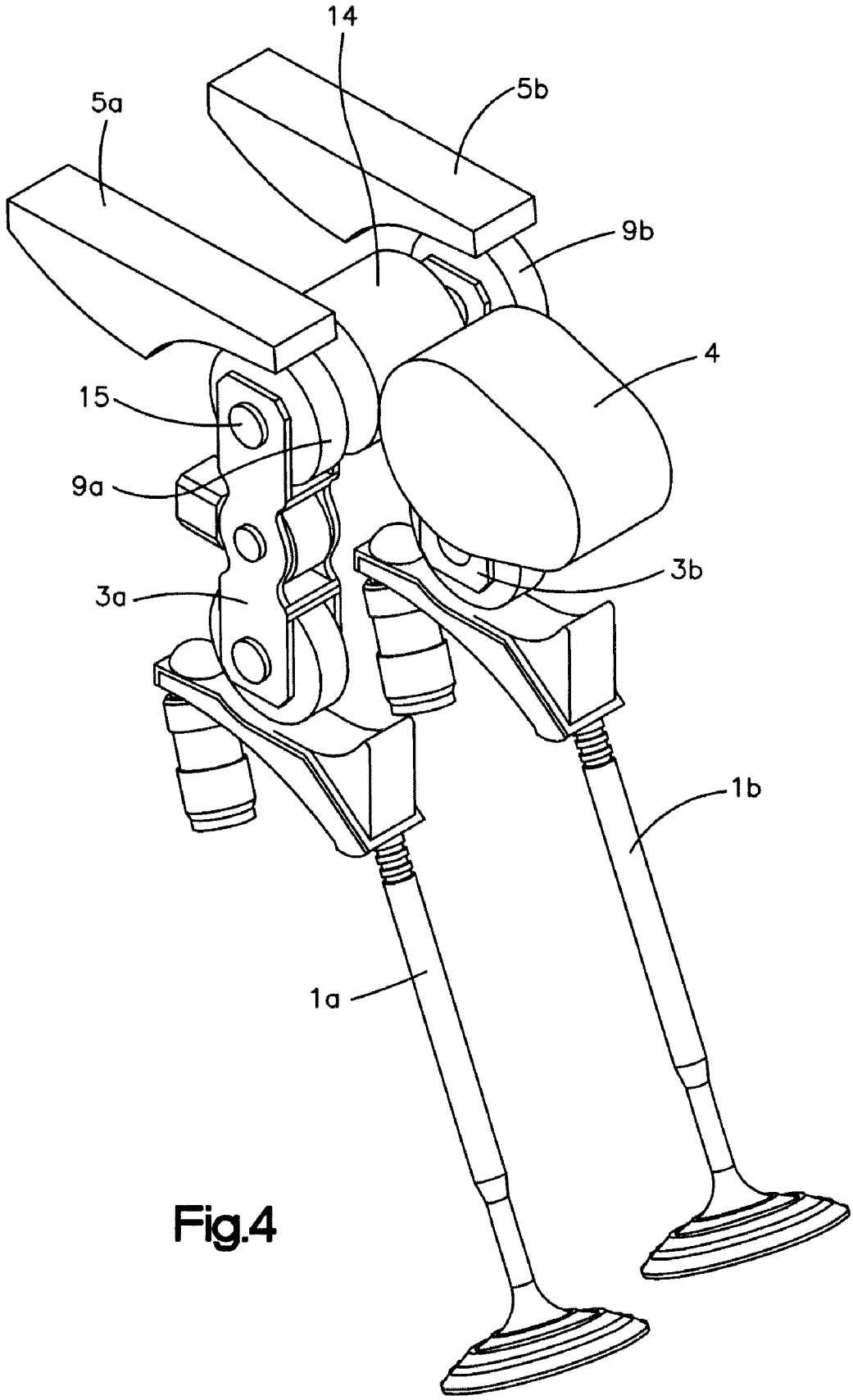
Figure 5:
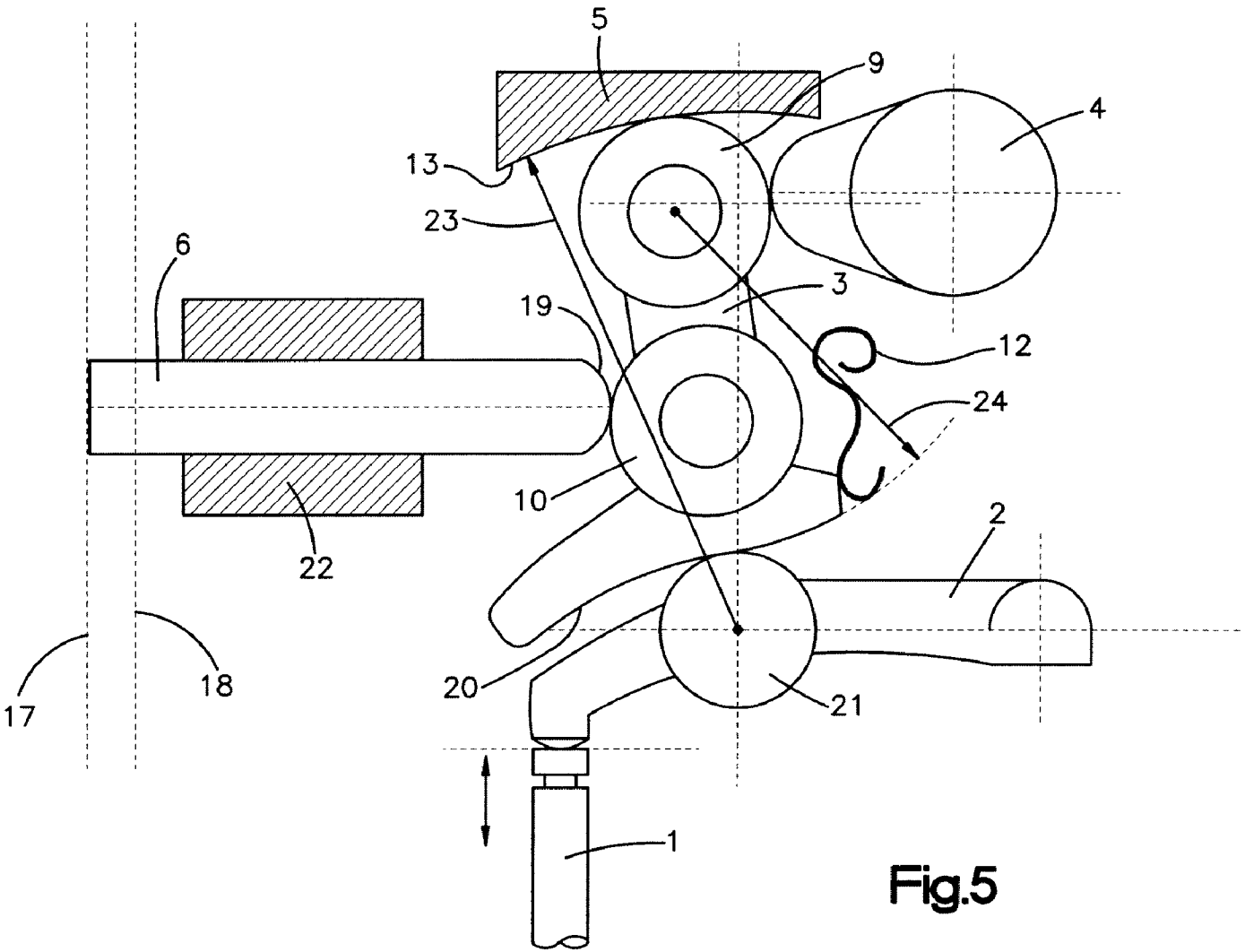
Figure 6A:
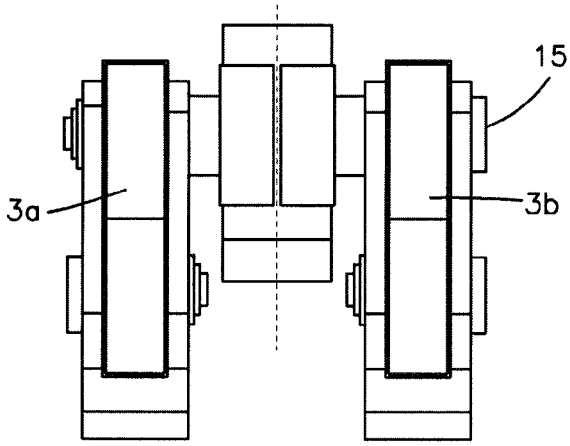
Figure 6B:
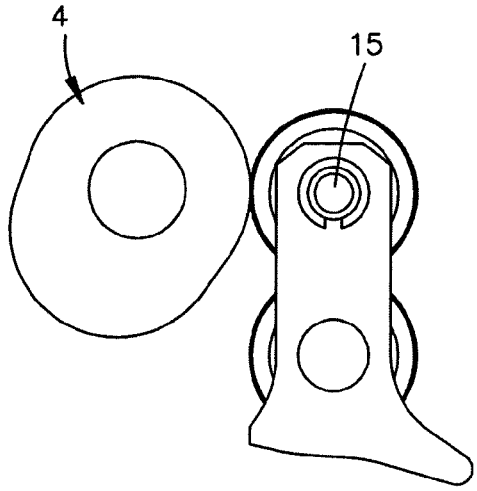
Figure 6C:
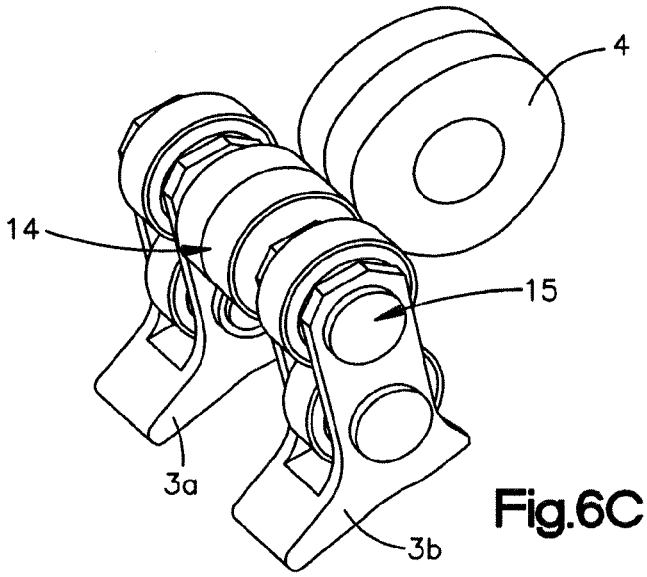

The invention is described in the following by examples. Hereby shows:

FIG. 1 a first embodiment of a device for adjusting the valve lift according to the invention for one intake valve;

FIG. 2 the first embodiment for the intake valve at zero valve lift position;

FIG. 3 the first embodiment for the intake valve in valve lift position;

FIG. 4 a second embodiment of the device for valve lift adjustment of the invention for two intake valves;

FIG. 5 a third embodiment of the device for valve lift adjustment according to the invention;

FIG. 6 an embodiment with two valves in three different views

Figure 7:
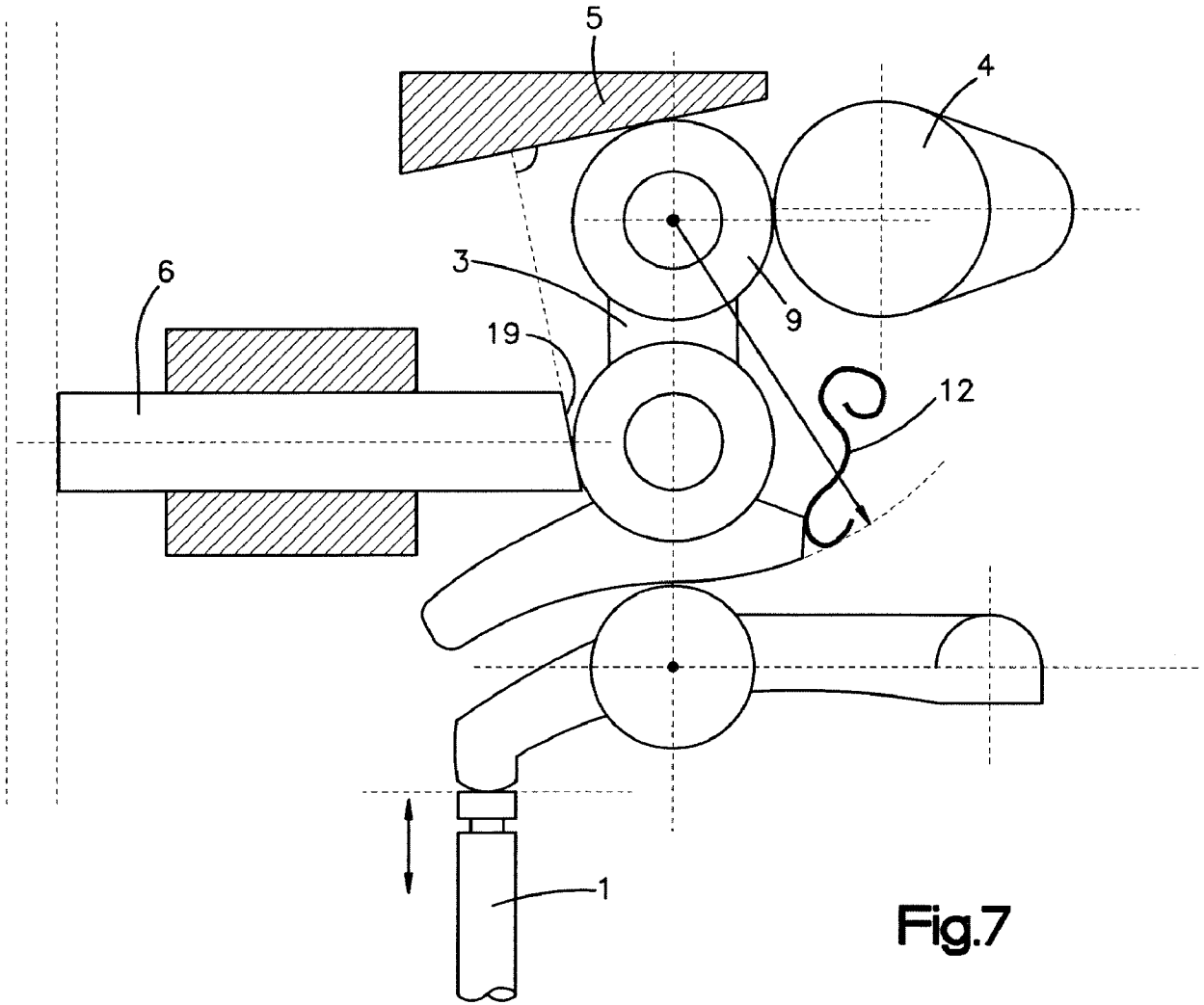

FIG. 7 a fourth embodiment having a plane contour and a plane bearing surface.

The FIGS. 1, 2 and 3 show a first embodiment of a valve lift adjustment device according to the invention for a gas exchange valve in the form of an intake valve 1 of a cylinder of a combustion engine which is not shown in the drawing. A rocker lever 3 comprising three rollers, an external roller 9, a body area of the lever which can comprise a roller 10 and an internal roller 11. That rocker lever 3 is driven by a camshaft 4 via the external roller 9 and moves during one revolution of the camshaft 4 along a path 13. The path 13 is determined by the shape of the bearing 5 which is attached to or which is part of the engine, whereby the rocker lever 3 moves via the inner roller 11 over a bearing 7, which forms a part of the valve engagement means (a turning lever) 2. The rocker lever 3 moves around its body area 10, an area between the external roller 9 and the internal roller 11 and which can comprise a roller, around the positioning means 6. The body area of the lever 10 can also be in the form of a rigid contour of the lever. For the adjustment of a valve lift 16 (FIG. 3) the positioning means 6 is positioned within a guide corresponding to a requested turning moment. The positioning means can take the positions 17 and 18 as shown in FIGS. 2 and 3. The position of the positioning means 6 determines the position of the pivot of the rocker lever 3 with respect to the vale engagement means and thus the area of the bearing 7 over which the roller 11 rolls. The bearing 7 is divided into areas, zero valve lift area 7*a* and valve lift area 7*b* (FIG. 1). These two areas are linked via transition radii or connection curves or by connecting planes, respectively. The radius of the curvature of the transition surface must be greater than the radius of the role 11 and determines the height of the acceleration ramp. If the roller 11 rolls during one revolution of the camshaft 4 only within the zero stroke area 7*a*, due to positions 17 of the positioning mean 6, the gas exchange valve 1 does not carry out a valve lift (FIG. 2). If the positioning means 6 is positioned to take the position 18, the roller 11 rolls during one revolution of the cam shaft 4 over the stroke area 7*b* of the bearing 7 and the gas exchange valve 1 carries out the maximum valve lift 16. Between positions 17 and 18 of the positioning means 6 (i.e. zero valve lift and maximum valve lift) every position can be adjusted. In those intermediate positions the gas exchange valve 1 carries out only a partial valve lift. The rocker lever 3 is pushed by a spring 12 towards the camshaft 4 during valve lift movements of the valve. A further embodiment comprising the bearing 7 being divided into several curved areas which are linked to each other through transition radii. The path 13 along in which the rocker lever 3 moves via the roller 9 is determined by the shape of the bearing 5. For example, the path 13 can have a circular, curved or semicircular surface or a plane surface.

In the second embodiment according to FIG. 4 two gas exchange valves 1*a* and 1*b* are operated by two rocker levers 3*a* and 3*b* being arranged on axis 15. The axis comprises, at its center between the rocker levers 3*a* and 3*b*, a common roller area 14 for the external rollers 9*a* and 9*b* which is either driven by the camshaft 4 (FIG. 4) or rolls over a bearing 5 that is attached to or is part of the engine. If the second roller area 14 rolls in the bearing 5, the first roller areas 9*a* and 9*b* are each driven by a cam 4. If the common second roller area 14 is driven by a cam of the camshaft 4, the two first roller areas 9*a* and 9*b* roll in two bearings 5*a* and 5*b* which are attached to or part of the engine. In another embodiment the three roller areas 9*a*, 9*b*, 14 are independent rollers and rest on a common axis 15.

A device for the valve lift adjustment of a gas exchange valve 1 of a not shown combustion engine is shown in FIG. 1 wherein the gas exchange valve 1 is, for example, one of several intake or exhaust valves. In this device the rocker lever 3 is driven by a cam shaft, moves around the positioning means and moves along a path which is determined by a bearing 5 that is attached to or part of the engine and 6. The position of the positioning means 6 determines the position of the pivot of the rocker lever and thus the area of the bearing 7 in which the roller 11 can roll. The bearing 7 is divided into two substantial areas; the zero valve lift area 7*a* and the valve lift area 7*b* (FIG. 1). If the roller 11 rolls during one revolution of the cam shaft only over the zero valve lift area 7*a*, due to the position of the positioning means, the valve 1 does not carry out a valve lift (FIG. 2). If the positioning means is brought into position 2, the roller 11 rolls during one revolution of the camshaft within the valve lift area 7*b* of the bearing 7 and the valve 1 carries out the maximum valve lift (FIG. 3). Between position 1 and 2 of the positioning means every position can be adjusted (FIGS. 2, 3). In those intermediate positions the valve carries out partial valve lifts. The rocker lever is pushed by a biasing means 12 towards the camshaft.

Since the roller 9 should not roll on the camshaft 4 and over the bearing 5 in the same time two levers are usually arranged on an axis 15 (FIG. 4). This axis 15 has at its center a roller 14 which rolls either over a bearing 5 that is attached to or part of the engine or is driven by the cam 4 (FIG. 4). If the roller 14 rolls in the bearing 5, the two external rollers 9*a* and 9*b* are each driven by a cam. If the roller 14 is driven by the cam 4, the two external rollers 9*a* and 9*b* roll in the two bearings 5*a* and 5*b* that are attached to or are part of the engine (FIG. 4). For a combustion engine having only one intake or exhaust valve per cylinder the rocker lever comprises an axis with three rollers where, for example, two rollers roll around the contour of the cam and the middle roller rolls over the bearing 5. In another suitable arrangement, the two external rollers roll over the bearing that is attached to or is part of the engine while the internal roller is driven by the cam of a camshaft.

FIG. 5 shows a device for a valve lift adjustment of valves according to the invention in particular of a gas exchange valve 1 of a not shown combustion engine, wherein the gas exchange valve 1 is one of several similar intake valves of a cylinder. In this device the rocker lever 3 is driven by the camshaft 4 and moves via the roller 9 along a path 13 which is determined by the bearing 5 that is attached to or is part of the engine. The rocker lever 3 moves via a second roller 10 around the contour 19 of the positioning means 6. The rocker lever 3 further comprises a working curve 20, which is in contact with the roller 21 of the valve engagement means 2, being here a roller lever. The positioning means 6 is positioned within a guide 22 for adjusting the valve lift. For example, a zero valve lift is carried out if the positioning means is brought into position 17 while a maximum valve lift of the intake valve 1 is carried out if the positioning means 6 is in position 18. A preferred geometry is given if the curvature of bearing 5 is determined by a circular arc 23 around the center point of roller 21 and the area of the working curve 20 forms a circular arc 24 around the center point of the roller 9. At this configuration the intake valve 1 is not opened during one revolution of the camshaft 4 if the positioning means 6 is in the zero valve lift position 17. The transition of the first area to the second area of the working curve 20 is limited by the radius of roller 21 and determines the shape of the ramp of the valve lifting curve during valve opening and closing. The second area of the working curve 20 defines the valve lift area. The shape of the working curve 20 determines the maximum valve lift and the valve acceleration of the partial valve lifts. The opening time of the valve lift is changed according to the invention dependent on the valve lift since the position of the positioning means 6 determines in which area of the working curve 20 the roller 21 rolls during one revolution of the cam shaft 4.

FIG. 6 shows that for example in a combustion engine having two intake valves, the rocker levers 3*a* and 3*b* can rest on a common axis 15 and the camshaft 4 can act on a roller located on the axis 15. The positioning means can take up different positions such that for one revolution of the camshaft 4 the intake valves have different valve opening times and have carried out different valve lifts.

A further embodiment of the invention shown in FIG. 7 where the bearing 5 and the contour 19 of the positioning means 6 have plane surfaces aligned perpendicularly to each other or which comprise between them an angle of 90°. The rocker lever 3 is pushed by a spring 12 towards the positioning means 6 and the camshaft 4, in order to keep the system free of play and prevent lifting of the lever 3 from the camshaft 4 or the positioning means 6 during high revolutions. The spring 12 can also be composed of two or more springs.

LIST OF THE REFERENCE NUMBERS USED HEREIN

1 gas exchange valve
1*a* gas exchange valve
1*b* gas exchange valve
2 drag lever (turning lever)
3 rocker lever
3*a* rocker lever
3*b* rocker lever
4 camshaft
5 bearing attached to or part of the engine
5*a* bearing attached to or part of the engine
5*b* bearing attached to or part of the engine
6 positioning means
7 bearing
7*a* zero valve lift area of the bearing
7*b* valve lift area of the bearing
8 bolt
9 external roller
9*a* external roller
9*b* external roller
10 roller (body area, rigid contour)
11 inner roller
12 spring
13 path
14 common second roller area
15 axis
16 valve lift
17 position 1 of the positioning means
18 position 2 of the positioning means
19 contour
20 working curve
21 roller
22 guide
23 circular arc
24 circular arc

The invention claimed is:

1. A device for adjusting valve lift in a combustion engine, the device comprising:

a cam shaft;

a first bearing;

a second bearing;

a valve in lifting engagement with the second bearing;

a rocker lever having first and second opposite ends and a body area with a pivot between the first and second opposite ends;

a first roller mounted on the first end of the rocker lever in rolling contact with the first bearing;

a second roller mounted on the second end of the rocker lever in rolling contact with the second bearing;

a positioning rail engaging the rocker lever at the body area beside the pivot; and a spring biasing the second roller into driven rolling contact with the cam shaft.

2. A device as defined in claim 1, wherein the positioning rail contacts the body area of the rocker lever.

3. A device as defined in claim 1, further comprising a third roller mounted on the body area of the rocker lever, and wherein the positioning rail contacts the third roller.

* * * * *